United States Patent [19]

Loughney

[11] 4,322,090

[45] Mar. 30, 1982

[54] SKI MOUNTAINEERING BINDING

[76] Inventor: Charles E. Loughney, 4225 - 83rd Ave. SE., Mercer Island, Wash. 98040

[21] Appl. No.: 121,019

[22] Filed: Feb. 13, 1980

[51] Int. Cl.[3] ..... A63C 9/08

[52] U.S. Cl. ..... 280/614; 280/615

[58] Field of Search ..... 280/614, 615, 618

[56] References Cited

U.S. PATENT DOCUMENTS

| | | | |
|---|---|---|---|
| 3,388,918 | 6/1968 | Hollenback | 280/614 |
| 3,492,014 | 7/1970 | Besser | 280/614 |
| 3,877,712 | 4/1975 | Weckeiser | 280/614 |
| 3,908,971 | 9/1975 | Engel | 280/614 |
| 4,088,342 | 5/1978 | Hausleithner | 280/614 |

FOREIGN PATENT DOCUMENTS

| | | | |
|---|---|---|---|
| 1728485 | 7/1973 | Fed. Rep. of Germany | 280/614 |

OTHER PUBLICATIONS

Karlheinz Reese, 1972.

*Primary Examiner*—Robert R. Song
*Attorney, Agent, or Firm*—Mattern, Deits, Kessler & Moravan

[57] ABSTRACT

A ski mountaineering binding, used for both alpine ski touring and downhill skiing, comprises a subassembly of ski boot binding components used for alpine ski touring, utilizing a hinged flexible touring plate under the sole of a skier's boot, and a subassembly of ski boot safety plate binding components used for downhill skiing. The subassembly of alpine ski touring ski boot binding components during downhill skiing are non flexibly secured from toe to heel, after the flexure interfitting of the rear of the hinged flexible touring plate to a non flexible downhill plate, to which the front of the hinged flexible touring plate is always pivotally secured. During alpine ski touring and downhill skiing the six way safety release functions of the downhill plate safety binding are potentially immediately available. During alpine ski touring a spring force applied at the pivotal securement of the hinged flexible touring plate is stronger at smaller angle positions of the ski boot relative to the ski and becomes weaker at larger angles, thereby making level or near level walking strides easier, yet making hillside side steps more convenient and safe, as the ski at these smaller angles tends to remain closely underneath the ski boot.

10 Claims, 14 Drawing Figures

SKI MOUNTAINEERING BINDING

BACKGROUND OF THE INVENTION

Although there are ski boot bindings available for on the spot conversion from a downhill skiing arrangement to an alpine ski touring arrangement of their respective components none are known which fulfill all of the following operational features:

Safety Release

A ski mountaineering binding must provide reliable safety release in both the downhill mode and in the touring mode. It is desirable to have the binding release in any direction of foot movement and the release should not be affected by any interaction from the ski boot such as the friction of the ski boot sole. The type of binding which today most nearly satisfies these requirements is known as the six way release plate type safety ski binding and this type should be used for ski mountaineering. A ski mountaineer skis and travels in steep and mountainous back country. His or her skis may be forced from his or her ski boots in any direction by entanglements with trees and brush, by falls in rough terrain and possibly by an avalanche.

Full Heel Lift

In the touring mode the ski boot should be free to rotate about a hinge located at the boot toe. The hinge location should be located close enough to the boot toe to allow a natural walking motion when traveling uphill or on the flat. The boot heel should be allowed to rise sufficiently without any obstruction from the binding to allow the natural walking motion. Experience has shown that a heel lift angle of approximately 65 degrees is satisfactory. The lifting motion of the boot should be friction free since any friction losses result in energy output by the ski mountaineer.

Change Over

The ski mountaineering binding must be readily changed over from the downhill mode to the ski mountaineering touring mode and then back again. The ski mountaineer should be able to easily accomplish the change over while wearing thick mittens and while exposed to severe winter storm conditions. The latching mechanism should have all its parts fully exposed so the inevitable ice, which forms, can easily be removed, for it is almost impractical to seal off a latching mechanism so ice will not collect on the latch parts, at some time because of various snow conditions. Adjustments or adapter devices of any kind should not be required for the change over while ski mountaineering. The binding should be readily adjustable to allow use with different sizes of ski mountaineering boots and also with different sized downhill ski boots.

Rigidity

The ski boot should be attached to the ski for downhill skiing and for ski touring in a rigid manner and without any looseness. The ski mountaineer often travels on steep icy slopes using the edges of her or his skis for support. This requires a rigid connection between the ski boot and the ski so the ski does not twist out from under the ski boot. Looseness or freeplay in the binding upsets the smooth movements required when performing downhill turns. In the touring mode it is desirable to allow the boot sole to flex slightly during walking.

Maneuvering Capability

Ski mountaineering bindings which have a freely pivoted hinge located at the toe of the boot for use in the touring mode allow the tail of the ski to drop down and "dangle" when the skier is side stepping or doing other maneuvers and particularly so on a steep slope. The ski tail will also drop down when the skier performs kick turns or if the skier walks backwards. This action of the ski tail dropping often forces the skier using a freely hinged binding to take a more circuitous route because he or she cannot readily climb a steep slope by sidestepping and because he or she generally feels less secure maneuvering on a steep slope. A ski mountaineering ski binding, in the touring mode, should incorporate a simple device which will hold the boot down flat onto the ski when the ski is lifted up above the surface of the snow. It has been found from ski touring experience, only a slight return force is required and only for the position where the ski boot is flat down or nearly flat against the ski without the heel being raised, or raised very little. This return force which will oppose raising of the boot heel during walking should be as small as practical, and this return force should decrease as the ski boot heel is raised farther up from the ski to aid a skier. If this return force would become larger as the boot heel is raised up and/or if there were friction forces to overcome, then these larger forces would require additional energy output by the skier, which would be essentially wasted energy, as the skier ascends a hill.

Durability

The ski mountaineering binding must be very durable. It is obvious, a binding failure in a remote mountain area would be very undesirable and would be critical. If the binding has parts which are subject to wear or breakage, then these parts should be easily replaceable and inspectable, so replacement can be made prior to failure. The binding must be kept lightweight but without compromising durability.

Ski Mountaineering Bindings Developed by Other Persons

Ski mountaineering bindings developed by other persons have met some of these desirable operational features. However, none of them have met all of these desirable operational features.

In U.S. Pat. No. 4,088,342, Andress Hausleithner, in 1978 illustrated and described his touring release binding for skis, which includes a hinged touring plate but does not incorporate a six way safety release. A ski equipped with this binding is maneuvered very well, yet the return force which tends to hold the ski boot and the touring plate flat against the ski increases rather than decreases, as the ski boot heel is raised up. This lifting of the touring plate and ski boot is opposed by a spring loaded blocking element with a force proportional to the lifting motion so that the force increases rather than decreases as the ski boot and touring plate are pivotally raised up. This same spring provides the force opposing safety release of the ski boot toe, so that adjustment of this spring for safety release undesirably changes the force which opposes lifting of the ski boot heel. Also there is a frictional rubbing contact which occurs between a blocking part and a sliding housing.

In U.S. Pat. No. 3,908,971, Steven F. Engel in 1975 illustrates and describes a ski binding which does not incorporate sufficient components to provide any desirable maneuvering capability. Also this ski binding appears to have a surface on the toe end of the touring plate which frictionally rubs against the downhill spring loaded release detent pin, during a skier's walking motion. This rubbing will use up the skier's energy to overcome this frictional loss.

In U.S. Pat. No. 3,877,712, Kurt A. Weckeiser in 1975 illustrates and describes his release ski binding for downhill and cross-country skiing. The safety release system requires the skier's boot to slide across the surface of the binding and some ski mountaineering boots have rubber lug soles which probably will not slide well to initiate a safe and timely release from this ski binding. Also Mr. Weckeiser's ski boot binding incorporates a torsion spring, which resists the raising of the skier's boot heel with an increasing force, as the ski boot heel is raised higher. Consequently, during walking with good strides a skier wastes his or her energy in overcoming the increasing force created by the torsional spring.

In U.S. Pat. No. 3,388,918, R. R. Hollenback in 1968, illustrated and described his ski binding using a releasable cable binding with a hinged supporting plate for the ski boot during ski touring. Then for downslope skiing the hinged supporting plate is latched at the heel. This binding does not provide all the maneuvering capability. The degrees of freedom of the walking motion is restricted to about thirty degrees. All the inherent disadvantages of cable bindings remain.

In U.S. Pat. No. 3,492,014, Besser in 1970 illustrated and described a ski binding for downhill skiing but not for crosscountry skiing, ski touring, and/or ski mountaineering. However, Mr. Besser's ski binding provided for full safety releases during forward and backward falls and sideways releases at both toe and heel. In his binding, the ski boot is first mounted on a sole plate having an adjustable heel and toe retaining means. Then the sole plate, with the ski boot, is releasably engaged at the toe of the sole plate to a spring biased detent member, which is responsive to rearward or sideward forces to thereby release the toe end of this sole plate. Also the sole plate, with the ski boot, has the heel end of the sole plate releasably held by a heel retainer, which is responsive to forward or sideward forces to release the heel end of the sole plate. When a skier tends to create abnormal forces during skiing, the entire sole plate, together with the skier's boot retained thereon, releases from the ski, thereby protecting the skier from injury.

Also, in about 1972, Karlheinz Reese illustrated and described an ISER ski boot touring binding having a flexible sole plate rotatable about its toe end for touring and lockable against the ski for downhill runs. Maneuvering capabilities were not extensive and safety releases were not sufficient.

Then in 1973, Hannes Marker, in his German Pat. No. 1,728,485 illustrated and described a ski binding for downhill skiing which has a sole plate which can lift up from the ski when it is released. The sole plate has a frontally releasing heel element. Also the sole plate is built in two layers with the lower layer pivoted to the ski surface and with both layers joined rigidly together in the area of the frontal sole holder. A mushroom shaped pin with a detachable head holds the lower sole plate layer to the ski and acts as a safety breaking point when exposed to excess stress.

SUMMARY OF THE INVENTION

This ski mountaineering binding provides for all the operational features set forth in the background. It is a ski boot binding for safe, excellent maneuvering, convenient, lower energy consumption alpine ski touring, and very safe and excellent control for downhill skiing. This ski mountaineering binding comprises a subassembly of ski boot binding components used for alpine ski touring centering on a hinged flexible touring plate under the complete sole of a skier's boot, and a spring tending to have its greatest return force, when the skier's boot with the flexible touring plate is on or near the ski, and to have a quickly decreasing return force, when the heel of the skier's boot with the flexible touring plate moves farther and upwardly above the ski. Then for downhill skiing this ski mountaineering binding comprises a subassembly of ski boot safety plate binding having all of the excellent six way safety releases, when a skier encounters serious trouble.

By this superimposing of the ski mountaineering touring binding subassembly on the downhill safety release ski boot binding subassembly the following operational features are met.

Safety Release

The downhill release components consist of a plate with a detent mounted on the toe end and a cam shaped tongue on the heel end. The plate is held to the ski by a spring loaded detent pin at the toe end of the plate, and by a recessed heel piece at the heel end of the plate. This downhill plate safety release arrangement provides six way safety release in both the downhill mode and in the touring mode and is commonly used in modern downhill ski plate ski boot bindings.

Full Heel Lift

A ski mountaineering flexible touring plate is mounted upon the downhill release plate by means of a friction free hinge having a large diameter hinge pin in a touring toe piece with self lubricated bearings at the toe end. This hinge is located close to the boot toe and allows for a sufficient heel lift up to 65 degrees, so a natural walking motion is available to the skier in the ski touring mode.

Change Over

The flexible touring plate has attached to it a touring heel plate to which the ski boot heel is attached by means of an overcenter ski boot heel latch similar to those commonly used on downhill type plate bindings. The ski boot heel latch holds the touring heel plate firmly against the bottom of the ski boot and holds the ski boot tightly against the touring toe piece through tension in the touring plate. In this position the touring heel plate is either engaged with a latch bar, which is mounted upon the downhill release plate, for downhill skiing, or is disengaged from the latch bar for ski mountaineering touring. Release of the ski boot heel latch and removal of the ski boot allows the touring plate to be flexed into an "S" shape which will withdraw the touring heel plate from under the latch bar, or conversely allow its insertion under the latch bar. This changeover from the downhill mode to the ski mountaineering touring mode can be readily accomplished by a skier who is wearing thick mittens while making the change over. The latch bar is fully exposed and can easily be cleaned of any ice which may have accumulated and which could prevent engagement with the touring heel plate. The touring toe piece has toe lugs which adjust for various thickness ski boot soles. The touring heel plate has a series of longitudinally spaced pairs of holes to allow the boot heel latch to be adjusted to fit various ski boots of different sizes. Also the heel plate will accommodate different width boots.

Rigidity

The touring plate on this ski mountaineering binding is held by a rigid hinge structure at the touring toe piece to the downhill release plate. This hinge has a large diameter hinge pin supported in bearings spaced widely apart. The touring plate is flexible to allow some bending of those ski mountaineering boots which have flexible soles. During downhill skiing the touring heel plate near the heel end engages a latch bar for full width of the boot so high loads from edging of skis on steep slopes can be resisted without undue twisting of the skier's ankles.

Maneuvering Capability

This ski mountaineering binding includes a touring spring and a crank to provide maneuvering capability in the touring mode. The touring spring provides a small spring force which opposes raising the ski boot heel from the ski when the boot and touring plate are in the full heel down position or tending to be in this position. The size of this small force has been determined by ski touring experience and is just sufficient to prevent the ski tail from dropping or dangling when the ski is raised up for side stepping and for doing other maneuvers on steep slopes or during kick turns or when walking backwards. This small spring force is applied through a crank, so as the boot heel is raised up, the line of action of the spring force approaches and passes through the hinge centerline.

Thus this spring force which opposes raising of the boot heel is biased so it decreases to zero as the boot heel raises up during a stride.

Durability

All parts of this ski mountaineering binding have been sized to provide durability. The touring system parts are light alloy metal or various plastics. The ski boot heel latch cable is the only part subject to wearing out and it is readily inspected and replaced.

DESCRIPTION OF THE DRAWINGS

A preferred embodiment of this ski mountaineering binding used for both alpine ski touring and downhill skiing, is illustrated in the drawings wherein.

DESCRIPTION OF THE PREFERRED EMBODIMENT OF THE INVENTION

Downhill Skiing and Alpine Ski Touring Binding Positions

Figure 1:
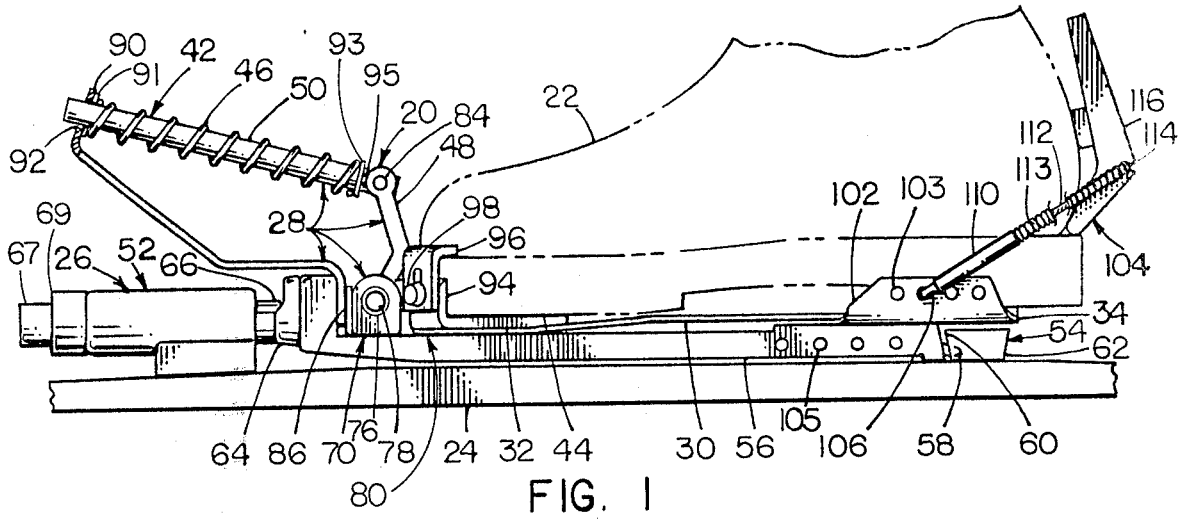
FIG. 1 is a side view of the ski mountaineering binding mounted on a snow ski, shown in part, and with portions of a ski boot, shown in phantom lines, in the downhill position.
Figure 2:
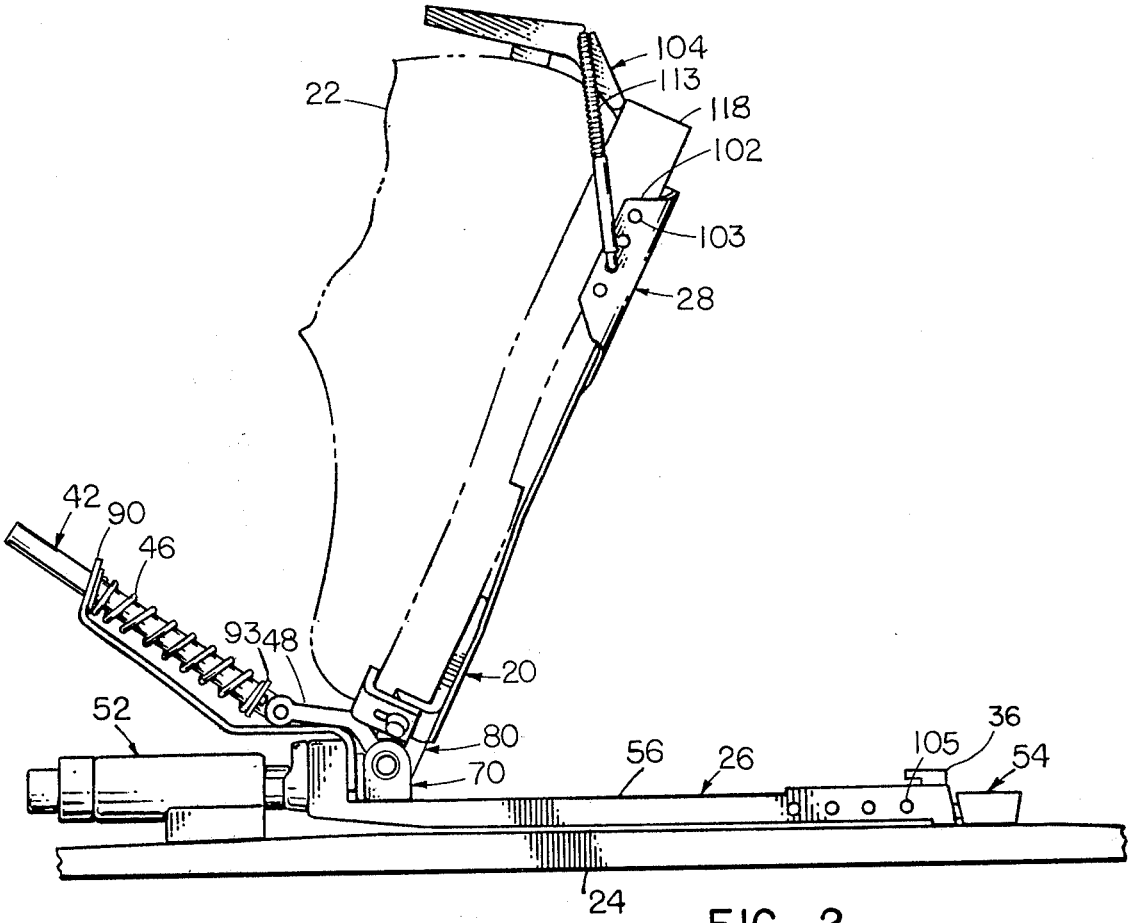
FIG. 2 is a side view of the ski mountaineering binding mounted on a snow ski, shown in part, and with portions of a ski boot, shown in phantom lines, in one of many alpine ski touring actively moving positions.

A preferred embodiment of this ski mountaineering binding 20, used for both alpine ski touring and downhill skiing, is illustrated throughout all the figures of the drawings. During downhill skiing, as shown in FIG. 1, the skier's foot in his or her ski boot 22 must remain closely and firmly positioned with respect to the ski 24. During alpine ski touring as shown in FIG. 2, the skier's foot in his or her ski boot 22 must remain firmly pivoted at its toe to the ski 24 and yet be controllably free to pivot about the toe with the heel of the ski boot 22 rotating through an extensive angle such as 65 degrees.

A Safety Release Ski Binding at All Times

Figure 3:
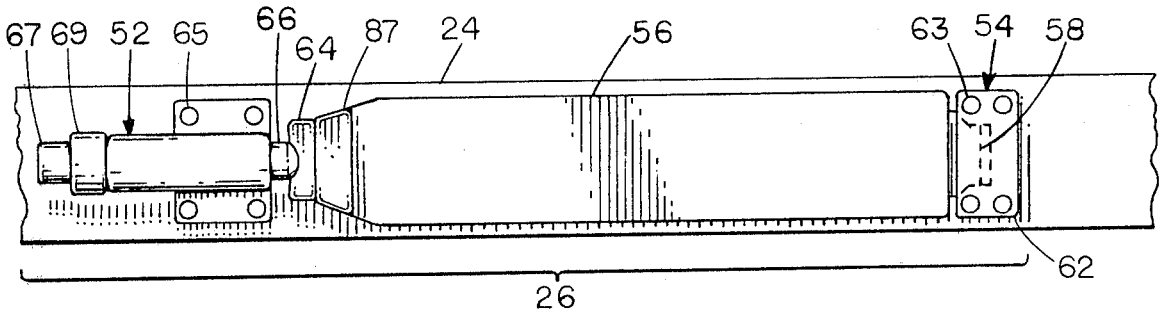
FIG. 3 is a top view of the components used of a ski plate safety release binding, with portions of a ski being shown.
Figure 4:
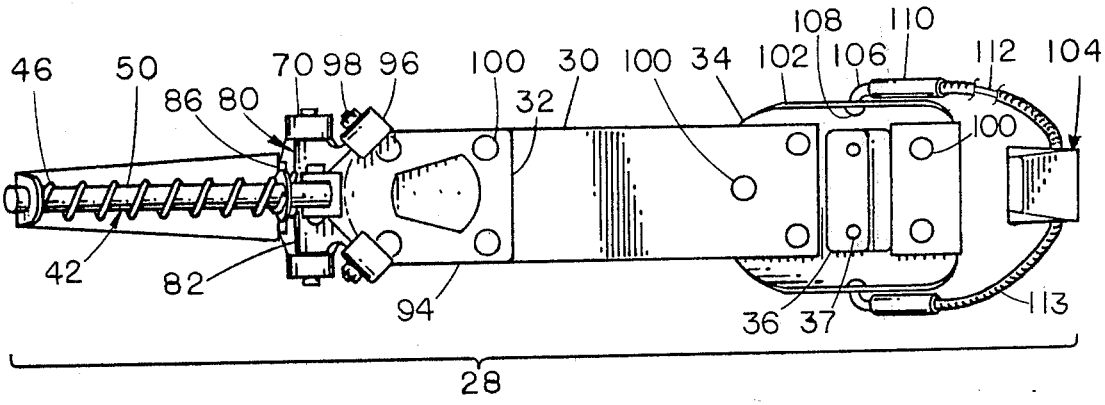
FIG. 4 is a top view of the components used to supplement the components illustrated in FIG. 3, to create a ski plate safety release binding used during alpine ski touring.
Figure 5:
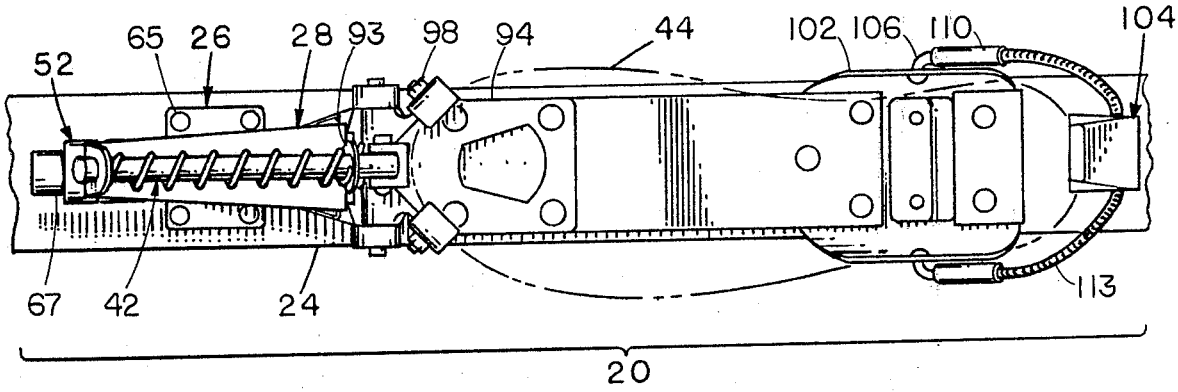
FIG. 5 is a top view of the components of FIG. 4 installed on top of the components of FIG. 3, thereby creating the ski plate safety release binding used during alpine ski touring and downhill skiing, with portions of a ski being shown.

The necessary firm downhill skiing binding arrangement as well as the controlled pivotal alpine ski touring binding arrangement, both, at all times, incorporate safety release binding components providing a six way release. As illustrated respectively in the three top views of FIGS. 3, 4 and 5: downhill ski binding components 26 of a downhill ski binding having safety release plate mechanisms are shown mounted on a ski in FIG. 3; ski touring ski binding components 28, to supplement the downhill ski binding components 26 to create a ski mountaineering binding 20 used during alpine ski touring, are shown by themselves in FIG. 4; and the combination of these components 26 and components 28, creating the ski mountaineering binding 20, is shown in FIG. 5.

Figure 6:
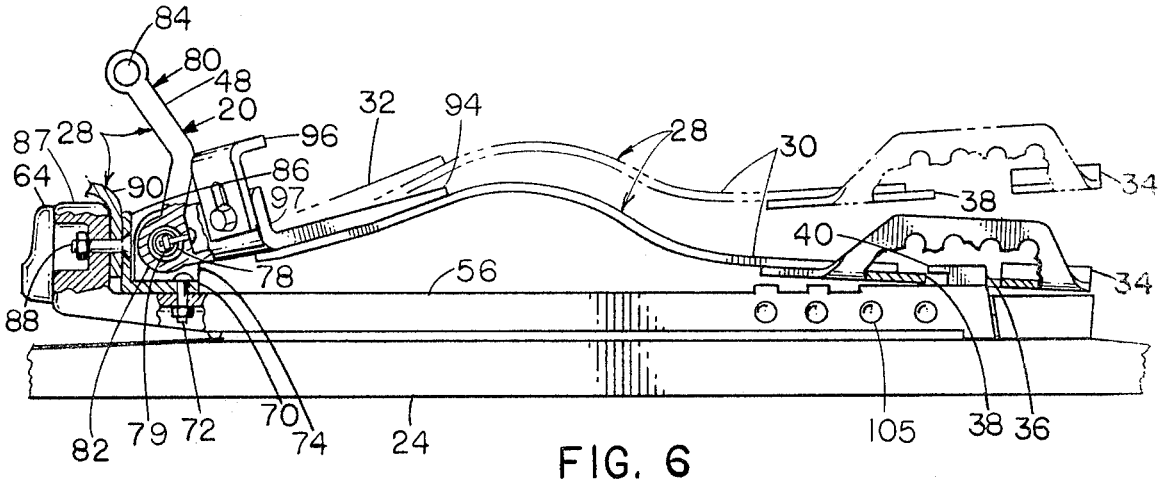
FIG. 6 is a partial side view of some of the overall components, illustrated in FIG. 5, indicating how the alpine ski touring components are flexibly manipulated to lock and to unlock them with respect to the ski plate safety release binding, with portions of a ski being shown.
Figure 7:
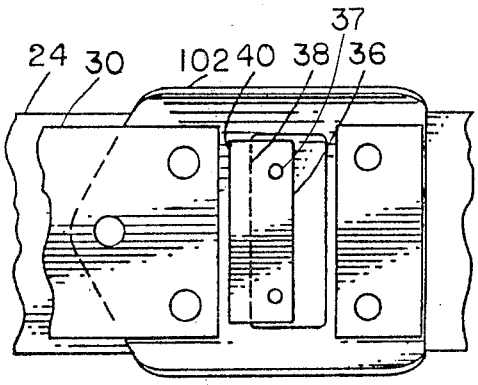
FIGS. 7 and 8, respectively, in a partial top view and a partial side view, illustrate the interlocking of the alpine ski touring heel components with the downhill heel components.
Figure 8:
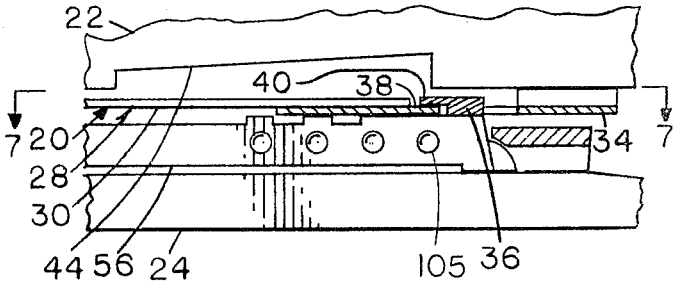
Figure 9:
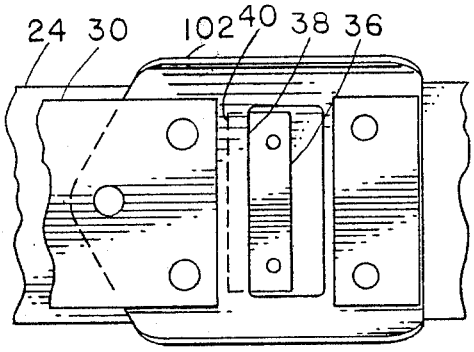
FIGS. 9 and 10, respectively, in a partial top view and a partial side view, illustrate the unlocked positions of the alpine ski touring heel components located nearby the downhill heel components.
Figure 10:
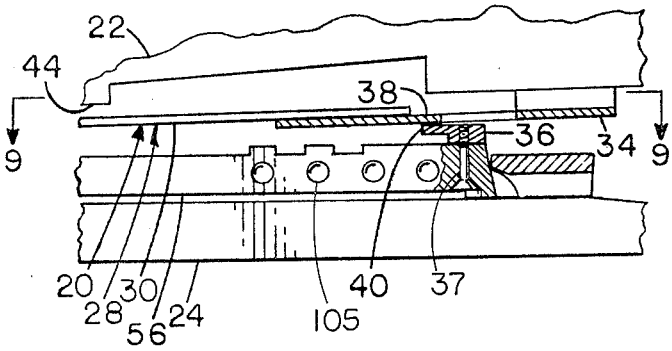

The Operational Changeover From the Locked Downhill Mode of Snow Skiing to the Unlocked Alpine Ski Touring Mode of Snow Skiing As illustrated in FIGS. 2 through 10, the operational changeover from the locked downhill mode of snow skiing, shown in FIGS. 7 and 8, to the unlocked alpine ski touring mode of snow skiing, shown in FIGS. 9 and 10, is undertaken, after removing the ski from a skier's ski boot 22, and then causing the upward flexure of ski touring flexible sole plate 30 as shown in FIG. 6. Such flexure of this sole plate 30, while it remains vertically pivotally mounted at its attached ski touring toe piece 32, clears its attached ski touring heel plate 34 from the ski touring heel plate latch bar 36, which is secured to the plate binding 26, by fasteners 37. When again the skier prepares for a downhill run, he or she reflexes the sole plate 30 to place the locking portion 38 of the ski touring heel plate 34 underneath a retaining flange 40 of the heel plate latch bar 36, for an interlocking fit, which is restrictive laterally as well as upwardly through this interlocking, and which is longitudinally restrictive under the force created against the ski boot sole 44 by the hold down cable and latch assembly 104.

Figure 11:
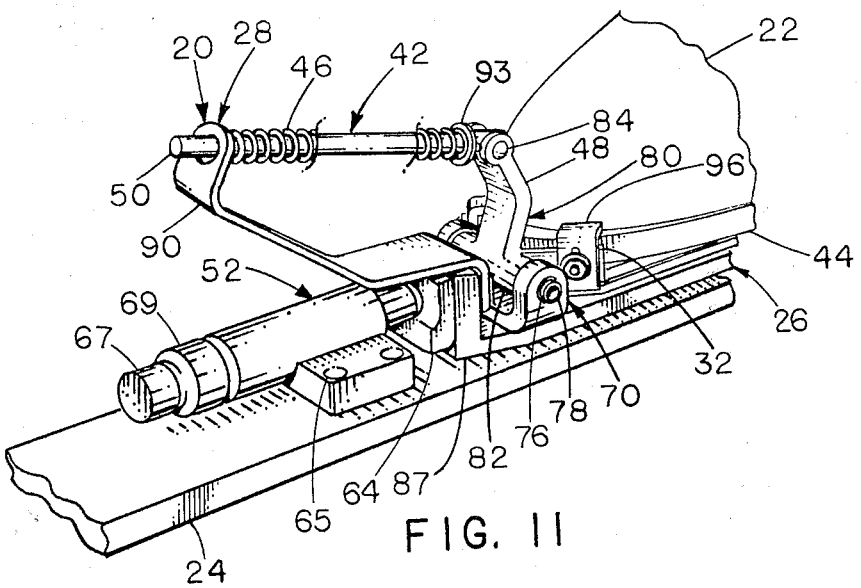
FIGS. 11 and 12 are partial perspective views indicating, respectively, the locations of the alpine ski touring spring assembly during its maximum effectiveness, when the ski boot heel is only slightly removed from the ski, and during its minimum effectiveness, when the ski boot heel is extensively removed from the ski, both positions occurring during alpine ski touring.
Figure 12:
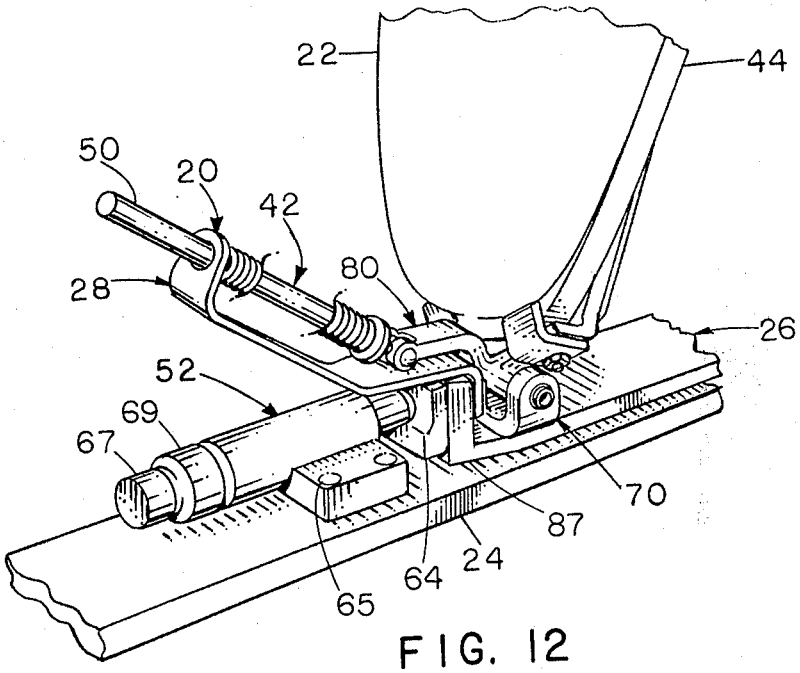

During Ski Touring, During Each Stride, there is a Reduction of the Return Spring Force, as the Angle Between the Pivoting Sole of the Ski Boot and the Ski, is Increased by the Skier's Intended Striding Movements; Yet at Small Angles the Stronger Spring Force Keeps the Ski Closely Adjacent the Sole of the Ski Boot As illustrated in FIGS. 11 and 12, there is a ski touring return spring assembly 42 both pivotally in part, and firmly in part mounted on, in part, and made integrally in part with the touring toe piece 32. As shown in FIG. 11, when the sole 44 of the ski boot 22 is essentially in contact with the downhill binding components 26, i.e. adjacent to the ski 24, a compression coiled ski touring spring 46 is most effective, through the motion of its pivotal crank arm 48, attached via pin 84 to its spring guide bar 50. The touring spring 46 is positioned on spring guide bar 50 between the upstanding forward end of support 90 with its hole 92 and washer 91, and a spring force receiving abutment washer 93, held in position by cross pin 95, transferring the spring force into the spring guide bar 50. The stronger spring force keeps the ski 24 in contact or near contact with the ski boot 22, via the downhill binding components 26, even though the ski touring binding components 28 are unlocked. When ski sidestepping, turning and lifting movements are being undertaken this contact or near contact relationship between the ski boot sole 44 and the ski 24 is wanted and is obtainable. Yet, when the skier wants to aggressively stride along over level or less steep terrain, as he or she intentionally pivotally moves the heel of the ski boot 22 upwardly above the ski 24, then the compression coiled ski touring spring 46 becomes less effective, through its pivotal crank arm 48, now in an almost in line position reducing the length of its torque arm, as illustrated in FIG. 12. A skier then in striding over level or less steep terrain uses less personal energy, than would be required, if the coiled spring force became progressively stronger, as the angle increased between the pivoting ski boot sole 44 and the ski 24. The coiled spring force, even at its maximum, is kept as low as possible.

The Ski Mountaineering Binding During Both Downhill and Ski Touring Configurations of Binding the Ski Boot to the Ski Includes Six Directional Ways of Releasing the Ski Boot From This Ski Binding, As Previously Noted, Now Further Described.

Figure 13:
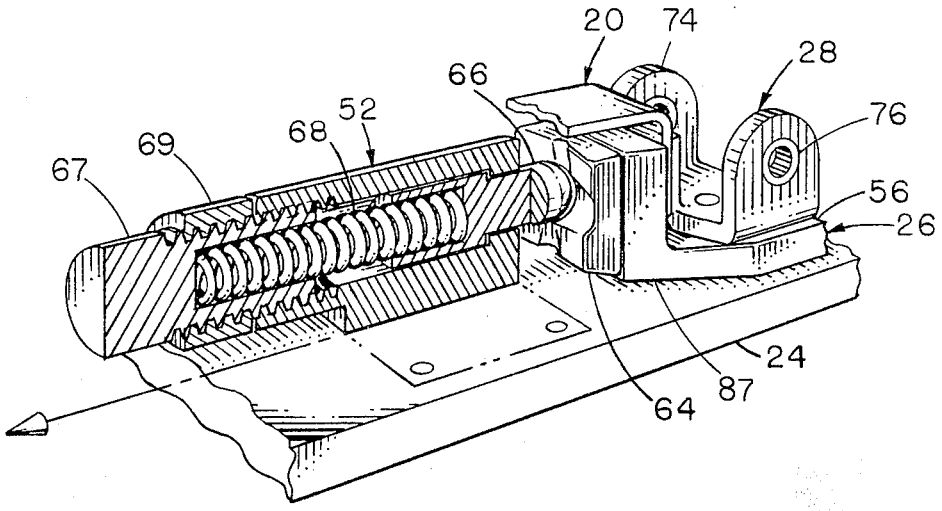
FIG. 13 is a partial perspective view, with some portions broken away for illustrative purposes, of the safety toe release portions of the plate ski binding and also of toe portions of the alpine ski touring binding, which are removably bolted to the plate of the downhill safety release plate binding, with a portion of a ski being shown.
Figure 14:
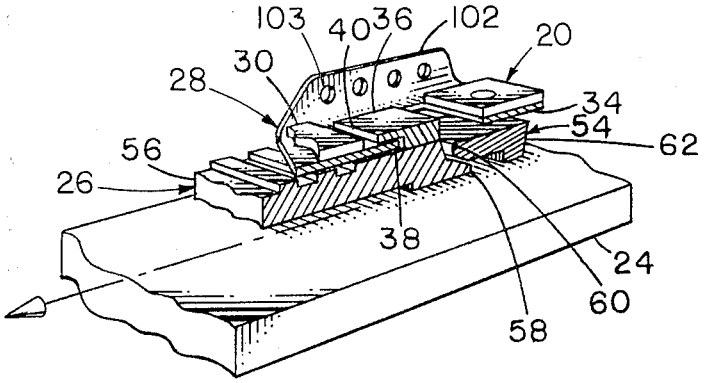
FIG. 14 is a partial perspective view, with some portions broken away for illustrative purposes, of the safety release heel end of the plate ski binding and the complementary receiving portions of this plate ski binding mounted on a ski, with a portion of a ski being shown, and also with heel portions of the alpine ski touring components being shown, and the arrow indicating the direction of the movement of the ski when moved by a skier.

As illustrated in FIGS. 13 and 14, components of a downhill ski safety plate binding 26 are always effective during both downhill skiing and alpine ski touring, providing release actions throughout all the six possible directional ways: forward fall, rearward fall, and four twisting forces applied respectively to the toe and heel portions of the foot in both left and right rotative directions. These downhill ski plate safety binding components were already available for downhill skiing. However, they are the important downhill binding components 26, which are combined with the ski touring components 28 to provide this ski mountaineering binding 20.

Attached to the ski 24 are a downhill ski plate toe piece assembly 52, secured by fasteners 65, and a downhill ski plate heel piece assembly 54, secured by fasteners 63, and spaced to receive the downhill plate 56, in a step in motion sequence. The heel end protruding tongue 58 of the downhill plate 56 is angled under a lip 60 of the downhill heel piece 62. Then the detent toe end structure 64 of the downhill plate 56 is radially moved downwardly into contact with a spring loaded hemispheric ended pin 66. This pin 66 momentarily deflects inwardly against the force of spring 68 to receive and then returns to hold the detent toe end structure 64 in place, completing the securement of the downhill skiing safety plate 56 to the ski 24. This securement is also accomplished, while a ski boot 22 remains fastened into the touring binding components 28, after a safety release has taken place. The effective force of the spring 68, is adjusted by selectively tightening or loosening the adjusting bolt 67 and then tightening its locking sleeve 69. Fasteners 65 hold toe piece assembly 52 in place.

The Toe Location Securement of the Ski Binding Components for Ski Touring to the Ski Plate Binding Components for Downhill Touring, Inclusive of a Full Laterally Extending Pivotal Axle or Touring Hinge Pin Supported in Low Friction Bearings Secured to a Hinged Mounting Assembly As shown in FIGS. 1, 2, 4, 5, 6, 11, and 12, a hinge mounting assembly 70 is bolted by fastener assemblies 72 and 88 to the toe end of the downhill plate 56. This assembly 70 serves as a multiple purpose support for many components which in turn are often joined together. The support 90 for the forward end of the spring bar 50 is secured between the upstanding mounting portion 86 of this assembly 70 and the upright forward end 87 of the downhill plate 56 using fastener assembly 88. The forward end of the spring glide bar 50 is slidably controlled while moving through the washer 91 and hole 92 of this support 90, as it inturns slidably and movably positions the ski touring spring 46. With respect to both sides of the downhill plate 56, this support assembly 70 has upstanding bearings supports 74 to receive low friction bearings 76, in turn rotatably supporting a full laterally extending touring hinge pin 78, also referred to as a pivotal axle 78. Secured to this hinge pin 78, by cross pin fastener assembly 79, is the multipurpose integral subassembly 80. It has several portions: a cylindrical portion 82 to surround the hinge pin 78; an upstanding radial crank arm portion 48 to pivotally support, via pin 84, the rear end of the spring guide bar 50, and combined longitudinal 94 and vertical 97 boot toe sole receiving portions 94. Also secured to these latter receiving portions 94 are adjustable height toe sole grippers 96, and the toe end of the ski touring flexible sole plate 30, using respective fastener assemblies 98, 100.

The Ski Mountaineering Binding is Readily Adjustable to Different Sized Ski Boots As illustrated in FIGS. 1, 2, 4, and 5, the ski touring heel plate 34 is attached to the ski touring flexible sole plate 30, using fastener assemblies 100, and it has upstanding mounting portions 102 at each side with spaced holes 103. The size and spacing of these holes 103 is similar to the holes 105, which are provided in the downhill plate 56, and used again if ever only the downhill safety plate binding is to be used.

Preferably, ski boot heel hold down cable and latch assembly 104, like an assembly used for a downhill safety plate binding, is secured to the ski touring heel plate 34 by using these paired spaced holes 103 in the upstanding mounting portions 102. Threaded bolts 106 with turned head ends 108 are passed through a pair of selected opposite holes 103 and pivotally secured to match with a respective length ski boot 22. The threaded ends of the bolts 106 are rotatably secured in screw barrels 110. Into the opposite ends of the screw barrels 110, the respective ends of cable 112 are also secured. On respective sides, spring sleeves 113 surround the cable 112. The respective top ends of the spring sleeves 113, with the cable 112, are restrained in the restrictive entry transverse slot 114 in the ski boot latch 116.

To match different length ski boots 22, there is a selection of the spaced paired holes 103, the number of actively held threads of bolts 106, and the selected length of the cable 112. To match the thickness of respective soles 44 of ski boots 22, the heights of the ski boot toe sole grippers 96 are adjusted.

To match different widths of heels 118 of ski boots 22, the turned head ends 108 of threaded bolts 106 are selectively inserted in different lateral directions through the respective opposite holes 103 in the upstanding mounting portions 102. When both are inserted from outside to inside, a wide ski boot heel 118 is accommodated. When both are inserted from inside to outside, a narrow ski boot heel 118 is accommodated. When one is inserted from outside to inside and the other turned head end 108 is inserted from inside to outside, then a medium ski boot heel 118 is accommodated. These overall adjustments make this ski mountaineering binding 20 universally adapted to essentially all sizes and types of ski boots 22 used during ski mountaineering, wherein alpine ski touring and downhill skiing may both be safely enjoyed, when this ski mountaineering binding 20 is installed on skis 24.

I claim:

1. Ski mountaineering binding for rigidly holding a ski boot relative to a snow ski, subject to safety releases, during downhill skiing, and for flexibly, rotatably, yet controllably, holding a ski boot relative to a snow ski, subject to safety releases, during alpine ski touring, comprising:

(a) a downhill safety release ski binding; and (b) a ski touring binding pivotally secured at its forward toe end to the forward toe portions of the downhill safety release ski binding for pivoting in a vertical plane above a snow ski and removably secured at its rear heel end to the rear heel portions of the downhill safety release ski binding, having;

(1) a return spring mechanism used during ski touring creating a spring force to constantly tend to keep the ski touring binding in a non pivoted position adjacent the downhill safety release ski binding, having;

(2) components in the return spring mechanism to alter the line of action of the created spring force, changing its created torque, to effectively reduce the application of the returning spring force as an intentional ski boot motion pivots the ski touring binding at its heel end upwardly away from the downhill safety release ski binding.

2. Ski mountaineering binding, as claimed in claim 1, wherein the downhill safety release ski binding is arranged as a downhill safety release plate binding, and the ski touring binding is arranged as a ski touring flexible plate binding.

3. Ski mountaineering binding, as claimed in claim 2, wherein in removably securing the ski touring binding at its rear heel end to the rear heel portions of the downhill safety release ski binding, a latching mechanism is used having a receiving portion on the downhill safety release ski binding and an insertable portion on the ski touring binding, and during the latching and unlatching the ski touring flexible plate binding is flexibly moved about its pivotal securement to the downhill safety release binding.

4. Ski mountaineering binding, as claimed in claim 3, wherein the ski touring binding has a ski boot heel end hold down latching assembly which is adjustable in its mounting position and in its length.

5. Ski mountaineering binding, as claimed in claim 4, wherein the ski touring binding has a ski boot toe end sole hold down assembly which is adjustable in height.

6. A ski touring binding for use in ski mountaineering, for flexibly, rotatably, yet controllably, holding a ski boot relative to a snow ski, comprising:

(a) a toe end assembly for mounting directly or indirectly to a snow ski in turn comprising (1) a ski boot toe end sole hold down assembly for pivotally mounting to the toe end assembly;

(2) a return spring assembly both pivotally, in part, and firmly, in part, mounted to the toe end assembly, including components to alter the line of action of the spring force, changing its created torque, to effectively reduce the application of the returning spring force as an intentional ski boot motion pivots the ski touring binding at its heel end upwardly away from the snow ski; and (b) a heel end assembly for mounting directly or indirectly to a snow ski, comprising a ski boot heel end hold down latching assembly.

7. A ski touring binding, as claimed in claim 6, wherein the toe end assembly and the heel end assembly are both secured to a ski touring flexible sole plate.

8. A ski touring binding, as claimed in claim 9, wherein the toe end assembly and the heel end assembly with their ski touring flexible sole plate, are removably attached to components of a safety plate ski binding, in turn adapted for six way release securement to a snow ski.

9. A return spring assembly for use on snow ski touring skis and snow ski mountaineering skis, comprising spring components and related components positioning and controlling the spring and acting together to create the return spring force which has its line of action altered changing its created torque, creating the maximum return spring force when the ski touring binding, throughout its length, is closely held adjacent a snow ski, and effectively reducing the application of the returning spring force as an intentional ski boot motion pivots the ski boot at its heel end upwardly away from the snow ski, thereby providing excellent control of the snow ski during side stepping, kick turning, walking backwards, etc., yet during striding on level or more level terrain reducing the human effort required in independently raising the heel of a ski boot above a snow ski.

10. A return spring assembly for use on snow skis, as claimed in claim 9, wherein the spring components and the related components positioning and controlling the spring and acting together to create the return spring force comprise:

(a) pivotable crank arm rotatably securable, directly or indirectly, to a ski, positioned upwardly when a ski boot is closely positioned on a ski throughout the length of the ski boot, and positioned forwardly when a ski boot is pivoted about its toe with its heel well removed from the ski;

(b) a stationary forwardly and upwardly positioned support firmly securable, directly or indirectly, to a ski just ahead of the pivotable crank arm mounting place;

(c) a spring guide bar pivotally secured to the pivoting end of the crank arm and slidably secured to the stationary support; and (d) a coiled spring compressively and slidably retained about the spring guide bar between the crank arm and the stationary support.

* * * * *